United States Patent [19]

Hallqvist

[11] 4,384,509

[45] May 24, 1983

[54] DEVICE FOR GUIDING A RAMMER HEAD IN ITS TRANSVERSAL DIRECTION

[75] Inventor: Sten Hallqvist, Karlskoga, Sweden

[73] Assignee: Aktiebolaget Bofors, Bofors, Sweden

[21] Appl. No.: 217,639

[22] Filed: Dec. 18, 1980

[30] Foreign Application Priority Data

Dec. 18, 1979 [SE] Sweden ..... 7910441

[51] Int. Cl.[3] ..... F41F 9/00

[52] U.S. Cl. ..... 89/47

[58] Field of Search ..... 89/45, 46, 47

[56] References Cited

U.S. PATENT DOCUMENTS 2,522,543 9/1950 Schiff ..... 89/45

*Primary Examiner*—Stephen C. Bentley

*Attorney, Agent, or Firm*—Pollock, Vande Sande & Priddy

[57] ABSTRACT

A rammer car has a rammer head which is movably supported in the transversal direction. The rammer car is composed of two units which are arranged to carry out a longitudinal displacement movement between the units in the riding direction of the rammer car. The rammer head is fastened in the first unit and the latter is arranged to be forced by the second unit to carry out a turning movement during the longitudinal displacement movement between the units, during which the rammer head follows the first unit and therewith carries out its turning movement in the transversal direction. After said longitudinal displacement movements the units are co-ordinated for a longitudinal displacement movement together in the longitudinal displacement direction.

7 Claims, 9 Drawing Figures

DEVICE FOR GUIDING A RAMMER HEAD IN ITS TRANSVERSAL DIRECTION

The present invention relates to a device belonging to a rammer car and a rammer head thereon movably supported in a transversal direction for guiding the rammer head in the transversal direction. A rammer car of this kind can be utilized for various firearms such as a field howitzer. In a known embodiment the rammer car is arranged in the elevating mass of the firearm and can be driven in a longitudinal direction of movement allotted to it which coincides with the longitudinal direction of the firearm and is parallel to the axis of the bore of the barrel. In the transversal direction, i.e. in a direction which coincides with a plane at right angles to the longitudinal direction, the rammer car supports a displaceable rammer head, which from a feeding position at the side of the firearm shall be capable of being swung in to a swung-in position coinciding with the extension of the axis of the bore. The rammer head is arranged to receive an ammunition unit, e.g. a bag charge or a propellant charge which is to be swung in to the axis of the bore, e.g. in order to be positioned behind a second ammunition unit in the form of a shell or the like, also swung in, but in a different way.

The reason for the possibility of swinging the rammer head to the side is that with the artillery piece in question it is desired to fire even at high angles of elevation, where the space behind the firearm as a rule is limited. This makes it desirable to have a short ramming length.

It has then previously proposed been the turning in or up from the side position to the turned in position of the rammer head should take place at the same time as a forward movement of the rammer head takes place. At a more rapid loading procedure for e.g. separate loading ammunition, the ramming length will thereby be comparatively long.

SUMMARY OF THE INVENTION

The purpose of the present invention is to solve this problem, and a device is proposed for guiding the rammer head which makes it possible to have a distinct and rapid lateral turning in and out of the rammer head, which moreover need not encroach on the ramming length.

In further developments of the concept of the invention detailed measures are proposed of a technically simple arrangement which gives a turning in of the rammer head before the rammer car itself begins to move. The further developments also take into consideration a technically simple and, accordingly, economic design on the whole.

However, the features that can mainly be considered to be according to the present invention will be noted from the claims.

ADVANTAGES

In addition to the fact that the lateral turning in and out of the rammer head does not encroach upon the ramming length, a reliable design is obtained, which provides for a rapid ramming procedure for the gun.

BRIEF DESCRIPTION OF DRAWINGS

An embodiment proposed at present of a device which has the characteristics significant for the invention will be described with reference to the accompanying drawings, in which FIG. 1 from above shows the rammer car with the rammer head belonging to it and a transmission gear for the rammer car in the guides is intended to be arranged in the firearm, not shown, on which it is intended to be possible to drive the rammer car in the longitudinal direction of the firearm, FIG. 2 from the side shows parts of the equipment according to FIG. 1, FIG. 3 from below shows the equipment according to FIG. 1, FIG. 4 from one end shows the equipment according to FIGS. 1–3, FIG. 5 in a vertical section along the section line A—A in FIG. 1 shows the design of the rammer car and the transmission gear at the section in question, FIG. 6 in a vertical section along the section line B—B in FIG. 1 shows the design of the rammer car and the transmission gear at the section in question, FIG. 7 in a section along the section line C—C in FIG. 4 shows the design of a first unit by means of which the rammer head is rotatably supported in the rammer car.

BEST MODE OF CARRYING OUT THE INVENTION

Figure 1:
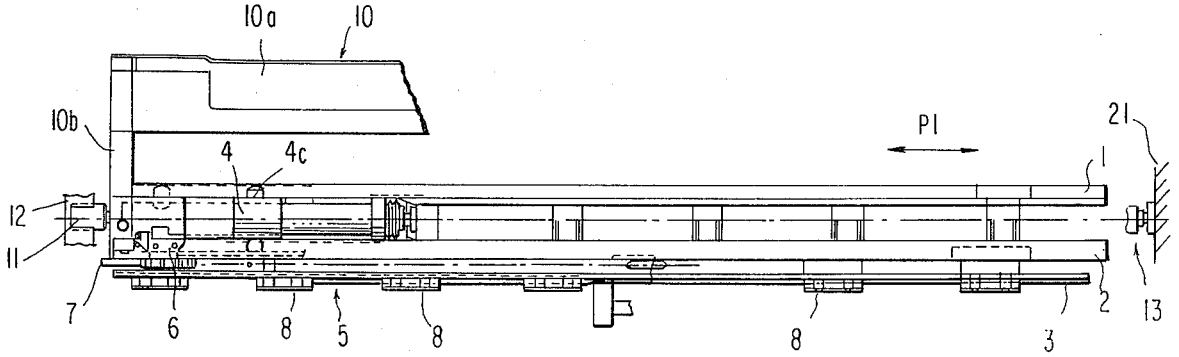

In FIG. 1, three guides arranged in the longitudinal direction of a firearm, not shown, are indicated by 1, 2, and 3, and between the guides 1 and 2 there is then arranged a rammer car which can be driven along the longitudinal direction of the guides, and between the guides 2 and 3 there is arranged, likewise along the guides in the direction of the arrows P, a transmission gear 5, which is known in itself, to which the rammer car 4 is connected with connecting means 6 of a kind which is known in itself. The transmission gear comprises a drive chain 7 which in a way which is known is connected with one of its ends to the guide frame and with its other end is connected to the movable part of the transmission gear 5, so that the latter will give the rammer car 4 a geared up ratio of 2:1.

The guides are braced with a number of brackets 8 and bracing elements 9 arranged along the longitudinal directions. On the rammer car there is supported a partly shown rammer head 10 which is rotatable in the transversal direction between a side position and a turned in or turned up position. The rammer head has a supporting part **10*a* for a propellant charge, not shown, or the like, and a supporting arm 10*b* at one end of the supporting part. The supporting arm 10*b* is fastened at the first end of the rammer car 4. In a starting position allotted to the rammer car, which corresponds to the position according to FIG. 1, the rammer car coacts with a spring stop 11 arranged in the elevating mass 12 of the firearm. The second end position of the rammer car 4, in which the rammer car is assumed to have inserted a shell with the associated bag charge into the chamber of the firearm is indicated by 13**.

Figure 2:
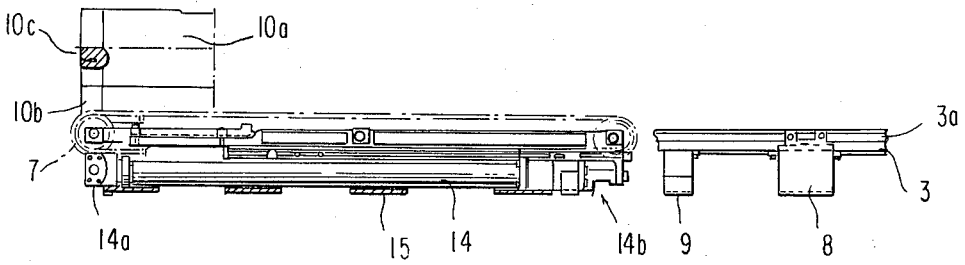

FIG. 2 is intended to show a hydraulic cylinder 14 for the transmission gear and therewith the driving of the rammer car. Also the hydraulic cylinder is braced up with brackets 15, and in its first end **14*a* the cylinder is fastened to the parts which are fixed in relation to the movable parts on the firearm. At its second end 14*b*** the piston of the cylinder is fastened to the movable parts of the transmission gear. FIG. 2 also shows fastening means 10c, by means of which the supporting part 10a is fastened in the supporting arm 10b.

Figure 3:
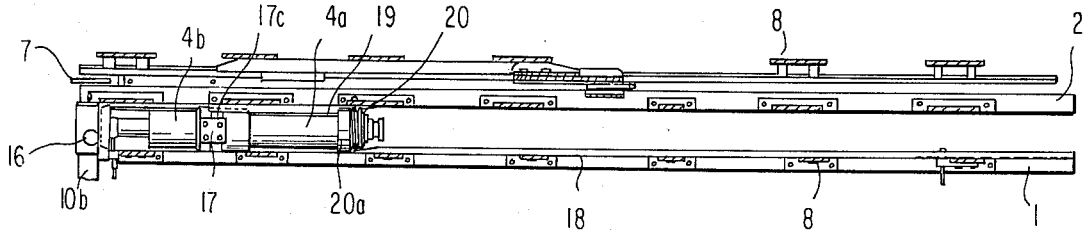

The rammer car is composed of two units which can be displaced longitudinally in relation to each other, of which in FIG. 3 the first unit has been designated 4a and the second unit 4b. In the example of the embodiment, the first unit has the form of an elongate shaft supported in the longitudinal direction inside the second unit, which has the form of a car which is displaceable in an initial stage in relation to the first unit. The car has four wheels or corresponding means (rollers, slide means, etc.) which have been indicated by 4c in FIG. 1. The wheels or the like are guided in grooves 1a, 2a (FIGS. 5 and 6) intended for this purpose in the guides 1 and 2.

In the starting position the first unit 4a is retained in its longitudinal displacement position until the car 4b, from the starting position shown in FIG. 2, has been moved forwards from the starting position a predetermined longitudinal displacement movement in relation to the first unit 4a. The first and second units 4a, 4b then coact with each other so that during this longitudinal displacement movement the second unit achieves a turning movement of the first unit which then turns around its own longitudinal axis. The rammer head 10 is fastened via its supporting arm 10b to the first end of the first unit 4a, and the rammer head turns when the first unit turns. The supporting arm 10b is connected to the first end surface of the first unit and is designed and fastened in such a way that the rammer head carries out its movement in the transversal direction when the second unit 4b is moved forwards in relation to the shaft 4a.

After the longitudinal displacement movement between the parts, blocking means 16 are exposed, which retain the shaft 4 in its present longitudinal displacement position during the longitudinal displacement movement, and the car 4b and the shaft 4a are connected together, to continue the movement together towards the second end position 13 of the rammer car. This requires that the transversal movement of the rammer head be carried out before the rammer car actually commences its riding in the longitudinal displacement direction.

For carrying out the connection function there are guide means which comprise a guiding device 17 which with sensing means 17a coact with a guide rail or cam 18 and 19 arranged at the guides 1 and 2, respectively. The cams 18 and 19 are set opposite each other, and their corresponding opposite surfaces are parallel to each other and arranged at the same direction along the entire extent of the guides, so that a transversally directed movement is obtained in the sensing means 17a in dependence on the longitudinal displacement position of the guiding device along the guides. As the guiding device 17 is fastened in the car 4b, the guiding device will sense different longitudinal displacement positions of the car along the guides. The guide means are connected together mechanically with connection means to be described on the car 4b which are arranged so that when the sensing means 17a is set as shown in FIG. 3, the connection means are out of engagement with a recess in the shaft 4a, and when the sensing means has been displaced in the transversal direction to its second position by the guide rails 18 and 19 when the rammer car has left the starting position, the connecting means are in engagement with shaft 4a via the recess.

At its second end (the front end) the shaft 4a has a spring or buffer unit 20, via which the shaft goes into coaction with a fixed stopping surface 21 (in FIG. (1) on the firearm. The spring unit 20 is fastened to the shaft via a flange 20a.

Figure 4:
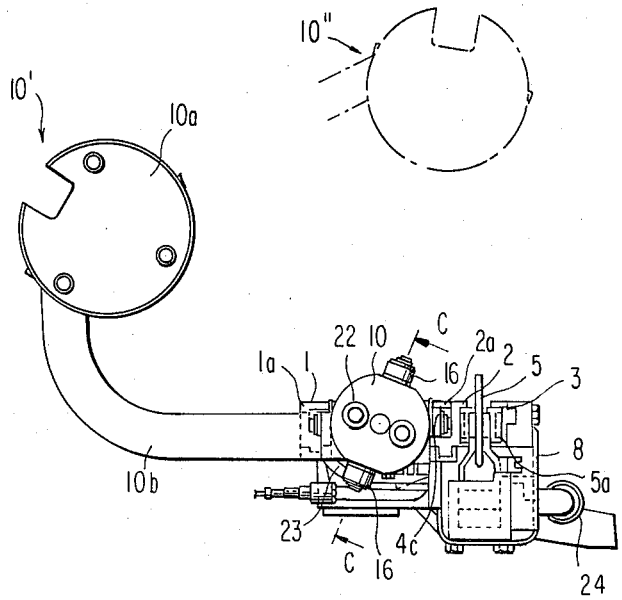

In FIG. 4, the side position of the rammer head in the transversal direction is indicated by solid lines 10', while the turned in or up position located in connection with the axis of the bore of the firearm is indicated by dash lines 10''. The supporting arm 10b comprises two parts, at angles to each other of approx. 90°. At its fastening end to the first unit the supporting arm has a disc-formed part which is fastened to the first end surface of the first unit by means of securing means 22.

FIG. 4 also shows the blocking means 16 in more detail. The blocking means comprise two diametrically opposite slide means, e.g. in the form of rollers or the like. When the first unit is applied in the starting position of the rammer car 4 and when the rammer head has assumed the side position 10', one of the rollers, 16', is in contact with a fixed holding surface 23 on the system which is fixed in relation to the movable rammer car. During the turning movement of the rammer head to the position 10'' the roller 16' slides against the holding surface 23 so that at the turned in position of the rammer head it will be opposite the longitudinal groove belonging to it of the longitudinal grooves 1a and 2a in the guides 1 and 2, respectively, in which grooves the wheels 4c of the second unit are arranged and guided. The roller 16 is also set opposite the one of the grooves belonging to it. Thus, also the first unit, via its rollers 16 and 16', will be guided in the grooves 1a, 2a during the riding movement together of the first and second units, whereby the blocking means will also have the function of guide means during the riding of the rammer car towards position 13 (FIG. 1).

FIG. 4 shows the guide means of the transmission gear 5, in the form of e.g. guide rails or guide elements, with a length of 40 mm, indicated by 5a, which guide means are in engagement with longitudinal guide grooves 3a (FIG. 2) in the guides 2 and 3. A supply pipe to the hydraulic cylinder 14 according to FIG. 2 is indicated by 24 in FIG. 4.

Figure 7:
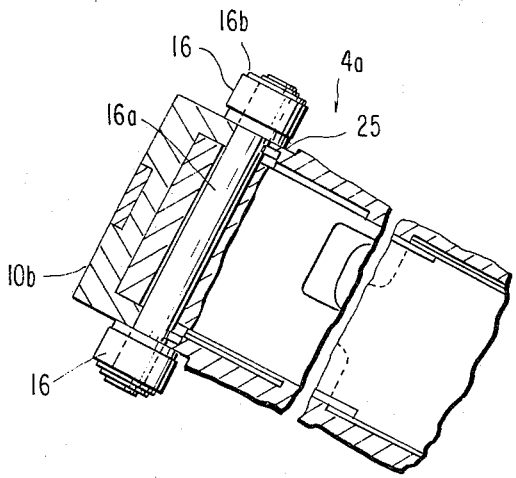

The rollers 16, 16', functioning as combined blocking and guide means, are shown in more detail in FIG. 7. The rollers are supported on a shaft 16a which is fixed to the first unit 4a by means of screws 25 or the like. On the shaft 16a the rollers are rotatably supported, and are retained on the shaft by means of stop washers 16b or the like, in a way which is known.

Figure 5:
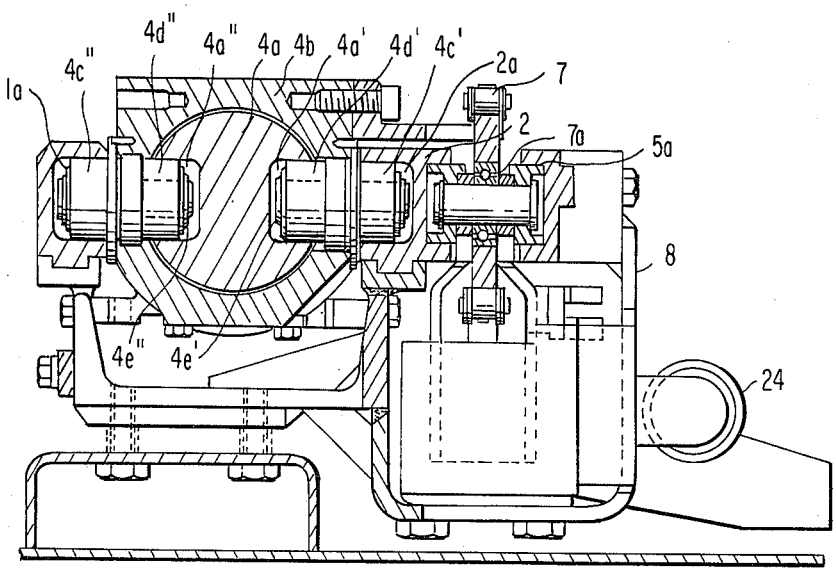
Figure 6:
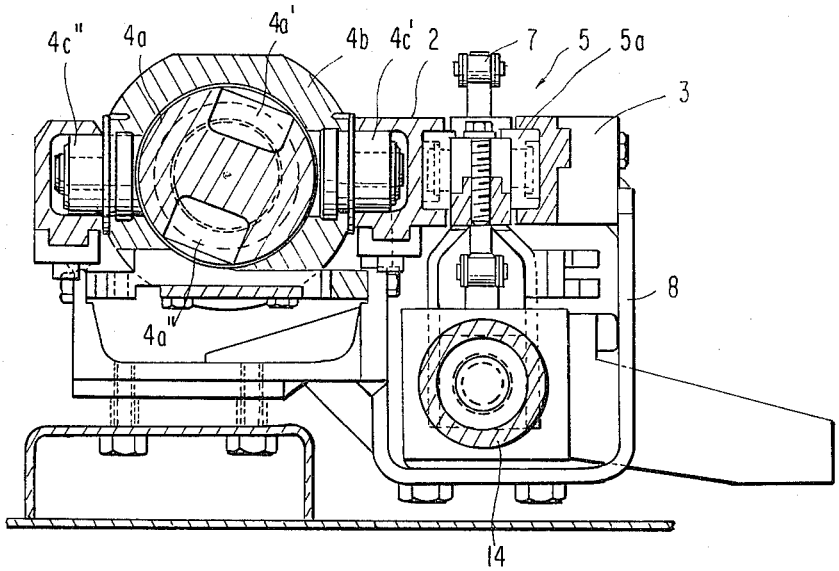

FIGS. 5 and 6 are intended to show the design of the first and second units 4a, 4b, on the rammer car, and also the design of the transmission gear 5. The rear pair of wheels on the second unit have been indicated by 4c' and 4c''. The round shaft 4a has two diametrically opposite grooves 4a' and 4a'' on its envelope surface, which are curved in the longitudinal direction of the shaft. The second unit 4b has a pair of wheels 4d', 4d'', directed inwards, or corresponding slide means which are in engagement with the shaft 4a via its grooves 4a' and 4a''. The pair of wheels directed inwards are supported on the shaft 4e', 4e'' as are the wheels on the rear pair of wheels 4c' and 4c'' on the second unit.

At the longitudinal displacement of the second unit in relation to the first unit, the first unit will be forced to carry out the turning movement desired because of the turning of the fixed pair of wheels directed inwards running in the curved grooves of the shaft 4b' which is freely supported in the turning direction. The pair of wheels which are directed inwards do not serve as connection means between the first and second units after the longitudinal displacement movements together, because of the great impact force which arises in conjunction with the ramming. Otherwise, the wheels in question could be damaged. As shown in FIG. 5, the chain wheel 7 in the transmission gear 5 is supported in a ball bearing 7*a*, in a way which is known.

Figure 8:
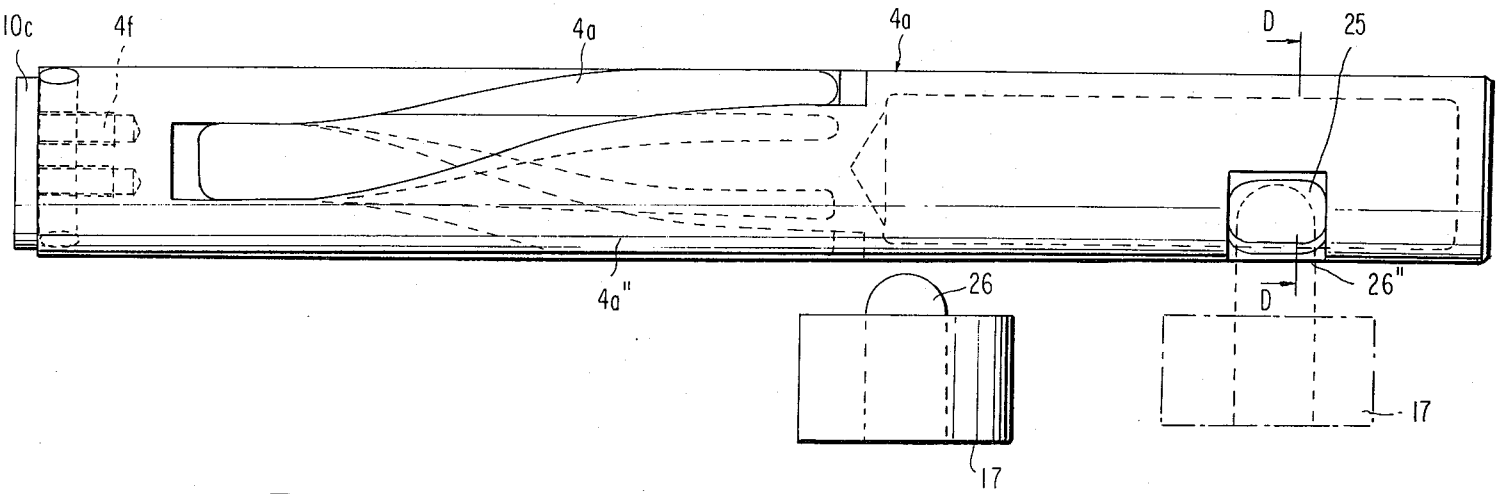
FIG. 8 shows an axle formed by the first unit in FIG. 7, and FIG. 9 in a cross section along the section line D—D in FIG. 1 shows the design of the axle.
Figure 9:
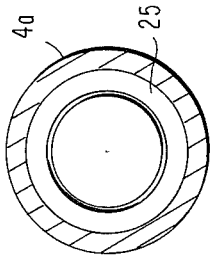

FIG. 8 shows the design of the grooves 4*a*′ and 4*a*″ of the first unit in more detail. The respective grooves start from a predetermined distance from the first end of the first unit 4*a* and along their total length are turned somewhat more than one quarter turn around the circumference of the shaft 4*a*. In the example of the embodiment, the grooves have a total length of approx. 250 mm.

In the first end, the shaft is provided with a screw hole 4*f* for the securing means 22, as above (FIG. 4). At its front end, the shaft 4*a* also has the above-mentioned recess 25 for the connection means, which are here represented by a stud 26. The stud 26 is connected with the guiding device 17 (FIG. 3) and can assume two different positions. The first position consists of the retracted position and is shown by 26 and 17, while the second position consists of a protruding position which is indicated by 26′ and 17′.

The stud 26 assumes the retracted position when the sensing device 17*a* is set in the position shown in FIG. 3. When the sensing device is moved over to its other position by the guide cams 17 and 18, the stud is actuated to its position shown by 26′, in which the stud is set opposite the recess 25 in the shaft 4*a* and therefore can extend into the recess. In this position, the stud serves as a carrier pin, and the shaft 4 is pulled along in the continued movement of the second unit, and it obtains guidance via its rollers 16, 16′.

FUNCTIONING

The functioning of the equipment described above will be briefly described as follows, it being assumed that the rammer head is set in its side position 10′ (FIG. 4). In this position, a bag charge or the like can be fed on to the supporting part 10*a* of the rammer head. In their starting positions, both the rammer car 4 and the transmission gear 5 are in the longitudinal displacement direction.

At an operating actuation via the hydraulic cylinder 14 (FIG. 2) the transmission gear 5 is actuated in the direction towards its second position and the transmission gear, in turn, actuates the rammer car in the direction towards its second end position. In the initial stage of this actuation the second unit 4*b* is forced by the transmission gear to move in relation to the first unit 4*a*, which is retained in its starting position by the blocking means 16. During this actuation the second unit forces the first unit to turn because of the pair of wheels 4*d*′ and 4*d*″ which are directed inwards of the second unit being in engagement with the curved grooves 4*a*′, 4*a*″ (FIGS. 5 and 6) on the first unit. During the relative longitudinal displacement movements the turning movement of the first unit is completed, and the rammer head which is fixed to the first unit is forced to carry out its movement in the transversal direction to the turned up position 10″, in which the rammer head is assumed to be located behind a shell or the like inserted in another way in the axis of the bore of the firearm and which is to be rammed by means of the front parts of the rammer head.

After the longitudinal displacement movement between the parts the blocking means 16 is exposed and thereafter serves as a guide means for the first unit. The first and second units are thereafter connected together, and the car formed by the first and second units can thereafter commence its riding movement determined by the hydraulic cylinder 14 or the ramming movement for ramming the shell and bag charge. In its second end position the ramming car goes against a fixed stop 21 via buffer means 20 on the first unit.

When the end position 13 has been reached the cylinder 14 pulls back the transmission gear 5 and the rammer car, and the reverse functioning process takes place, i.e. the connection means 25, 26 are exposed, the first unit strikes against the stop 11, and thereafter the second unit continues rearwards in relation to the first unit until it has reached its starting position. During the last-mentioned relative movement between the first and second units the rammer head is turned back from its turned in position to its position turned out to the side, where a new feeding can take place, etc. The pair of wheels 4*d*′ and 4*d*″ which are directed inwards are thus all the time engaged in the grooves 4*a*′ and 4*a*″ in the first unit, and work between the respective ends of the grooves and achieve the respective side movement of the rammer head, which will thus be turned in its transversal plane at right angles to the longitudinal displacement direction before the rammer car moves.

The invention is not limited to the embodiment shown above as an example, but can be subject to modifications within the scope of the following claims.

INDUSTRIAL APPLICABILITY

The parts to which the invention relates are easy to manufacture and integrate with a firearm in question at efficient manufacture at a factory.

I claim:

1. In an artillery piece which receives in a chamber an ammunition unit from a ramming action, an apparatus for ramming said ammunition unit into said chamber comprising:

a pair of spaced apart longitudinal guides for guiding a rammer head between first and second positions;

a rammer car comprising:

a first unit including an elongated shaft extending along the longitudinal axis of said guides bearing first and second circumferential grooves curved in the longitudinal direction, and first and second slide means located on said shaft and rotatable from a rest position at one end of said guides into a second angularly displaced position for entering said guides;

a second unit having a pair of wheels for engaging said guides, and an aperture for receiving said shaft, said second unit including inwardly directed slide means engaging said grooves whereby during longitudinal displacement of said second unit with respect to said first unit said shaft rotates;

a rammer head supported by a transversely extending arm to said first unit shaft, whereby during movement of said first unit against said second unit said rammer head is rotated into ramming position from a charge receiving position; and actuating means for moving said second unit with respect to said first unit along said guides whereby said rammer head rotates and said first unit wheels engage said guides for movement with said second unit along said guides.

2. An apparatus according to claim 1 further comprising:

blocking means for maintaining said first unit in a predetermined longitudinal starting position until said shaft has rotated.

3. An apparatus according to claim 2 wherein said blocking means comprises said first unit slide means which coacts with a holding surface fixed with respect to said rammer car until said shaft rotates said slide means away from said holding surface and into alignment with said guides.

4. An apparatus according to claim 3 comprising means for maintaining said first and second units together when said rammer car has reached an end of its travel along said guides.

5. An apparatus according to claim 4 wherein said means for maintaining said first and second units together comprises a stud movable from a first retracted position in said second unit to an engaging position within a recess of said first unit.

6. An apparatus according to claim 5 wherein said stud is displaced by a sensing means for detecting the longitudinal position of said rammer car along said guides.

7. An apparatus according to claim 3, wherein the blocking means and slide means have the form of rollers supported on the first end of the shaft which in starting position coact with the holding surface during the turning movement of the rammer head from a change receiving position to a turned in ramming position and said rollers in said turned in position go into engagement with guide grooves in said guides thereby form guide means for the first unit.

* * * * *